US009523272B2

(12) United States Patent
McMillon et al.

(10) Patent No.: US 9,523,272 B2
(45) Date of Patent: Dec. 20, 2016

(54) AMPLIFICATION OF DATA-ENCODED SOUND WAVES WITHIN A RESONANT AREA

(71) Applicant: Halliburton Energy Services, Inc., Houston, TX (US)

(72) Inventors: Christopher M. McMillon, Carrollton, TX (US); Michael L. Fripp, Carrollton, TX (US); Gregory T. Werkheiser, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/022,897

(22) PCT Filed: Dec. 28, 2013

(86) PCT No.: PCT/US2013/078150
§ 371 (c)(1),
(2) Date: Mar. 17, 2016

(87) PCT Pub. No.: WO2015/099800
PCT Pub. Date: Jul. 2, 2015

(65) Prior Publication Data
US 2016/0230545 A1 Aug. 11, 2016

(51) Int. Cl.
*E21B 47/14* (2006.01)
*E21B 47/09* (2012.01)

(52) U.S. Cl.
CPC ..... *E21B 47/14* (2013.01); *E21B 47/091* (2013.01)

(58) Field of Classification Search
CPC ..... E21B 47/12; E21B 47/14; E21B 41/091
See application file for complete search history.

(56) References Cited

U.S. PATENT DOCUMENTS

| | | | |
|---|---|---|---|
| 3,190,388 | A | 6/1965 | Moser et al. |
| 3,283,833 | A | 11/1966 | Bodine, Jr. |
| 4,674,067 | A | 6/1987 | Zemanek, Jr. et al. |
| 4,691,203 | A | 9/1987 | Rubin et al. |
| 4,962,671 | A | 10/1990 | Stansfeld et al. |
| 5,936,913 | A | 8/1999 | Gill et al. |
| 6,082,484 | A | 7/2000 | Molz et al. |

(Continued)

FOREIGN PATENT DOCUMENTS

| | | | |
|---|---|---|---|
| CN | 2557889 | Y | 6/2003 |
| CN | 1215298 | C | 8/2005 |

OTHER PUBLICATIONS

International Search Report and Written Opinion date mailed Sep. 22, 2014; International PCT Application No. PCT/US2013/078150.

(Continued)

*Primary Examiner* — Curtis Odom
(74) *Attorney, Agent, or Firm* — McGuireWoods LLP

(57) ABSTRACT

A method of amplifying a data-encoded acoustic signal in an oil or gas well system comprising: performing at least a first transmission of the data-encoded acoustic signal from a transmitter towards a receiver, wherein at least some of the data-encoded acoustic signal is reflected from a well system object; providing an impedance mismatch point; and causing or allowing amplification of the data-encoded acoustic signal, wherein the amplification is due to the well system object, the impedance mismatch point, and the transmitter.

20 Claims, 4 Drawing Sheets

(56) References Cited

U.S. PATENT DOCUMENTS

| | | | | |
|---|---|---|---|---|
| 6,615,949 | B1 | 9/2003 | Egerev et al. | |
| 6,697,298 | B1 | 2/2004 | Dubinsky et al. | |
| 6,874,361 | B1 | 4/2005 | Meltz et al. | |
| 6,915,875 | B2 | 7/2005 | Dubinsky | |
| 7,028,806 | B2 | 4/2006 | Dubinsky et al. | |
| 7,032,707 | B2 | 4/2006 | Egerev et al. | |
| 2002/0148606 | A1 | 10/2002 | Zheng et al. | |
| 2007/0030762 | A1 | 2/2007 | Huang et al. | |
| 2007/0075874 | A1 * | 4/2007 | Shah | E21B 47/12 340/853.7 |
| 2007/0194947 | A1 | 8/2007 | Huang et al. | |
| 2012/0126992 | A1 | 5/2012 | Rodney et al. | |

OTHER PUBLICATIONS

"Acoustic Logging Based on Wellbore Resonance (Abstract)"; Medlin et al., SPE Formulation Evaluation, vol. 11, No. 2, 1996.

* cited by examiner

AMPLIFICATION OF DATA-ENCODED SOUND WAVES WITHIN A RESONANT AREA

TECHNICAL FIELD

Data can be encoded in sound waves and used to communicate information about a well system or to well system components. The strength of the acoustic signal can be amplified using an impedance mismatch point and a transmitter. The amplified signal can then pass through larger mass well system objects to ultimately reach a receiver.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
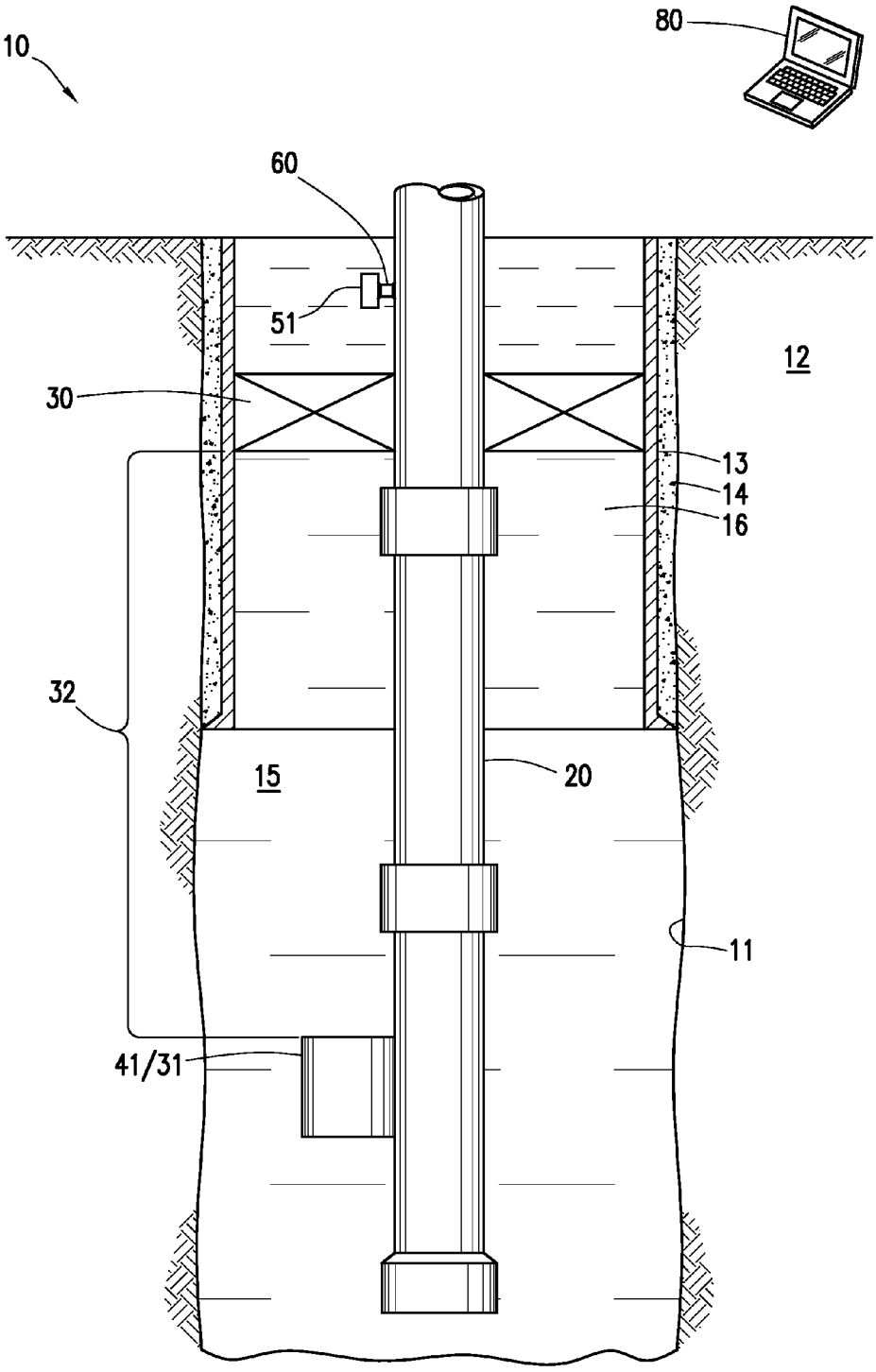
FIG. 1 is a schematic diagram showing a well system including an amplification system according to an embodiment where a transmitter creates an impedance mismatch point.

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more repeaters, transmissions, etc., as the case may be, and does not indicate any particular orientation or sequence. Furthermore, it is to be understood that the mere use of the term "first" does not require that there be any "second," and the mere use of the term "second" does not require that there be any "third," etc.

As used herein, a "fluid" is a substance that can flow and conform to the outline of its container when the substance is tested at a temperature of 71° F. (22° C.) and a pressure of one atmosphere "atm" (0.1 megapascals "MPa"). A fluid can be a liquid or gas. A fluid can have only one phase or more than one distinct phase. A solution is an example of a fluid having only one distinct phase. A heterogeneous fluid is an example of a fluid having more than one distinct phase. A heterogeneous fluid can be: a slurry, which includes a continuous liquid phase and undissolved solid particles as the dispersed phase; an emulsion, which includes a continuous liquid phase and at least one dispersed phase of immiscible liquid droplets; a foam, which includes a continuous liquid phase and a gas as the dispersed phase; or a mist, which includes a continuous gas phase and liquid droplets as the dispersed phase. Any of the phases of a heterogeneous fluid can contain dissolved materials and/or undissolved solids.

Oil and gas hydrocarbons are naturally occurring in some subterranean formations. In the oil and gas industry, a subterranean formation containing oil, gas, or water is referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from the wellbore is called a reservoir fluid.

A well can include, without limitation, an oil, gas, or water production well, an injection well, or a geothermal well. As used herein, a "well" includes at least one wellbore. The wellbore is drilled into a subterranean formation. The subterranean formation can be a part of a reservoir or adjacent to a reservoir. In offshore drilling, the subterranean formation is located beneath a body of water. A rig is located at the surface of the body of water and a tubing string runs from the rig through the body of water to the surface of the formation and into the formation wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore, which can also contain a tubing string. A wellbore can contain one or more annuli. Examples of an annulus include, but are not limited to: the space between the wall of the wellbore and the outside of a tubing string in an open-hole wellbore; the space between the wall of the wellbore and the outside of a casing in a cased-hole wellbore; and the space between the inside of a first tubing string and the outside of a second tubing string, such as a casing.

It is often useful to use acoustics during various oil or gas operations (e.g., drilling, logging, or completion) for a variety of applications. Acoustics deals with mechanical waves in a solid, liquid, or gas via vibration, sound, infrasound, or ultrasound. One example of such an application is to send information or a command that communicates with or activates downhole tools or components. As used herein, the term "downhole" means at a location beneath the Earth's surface and/or beneath the surface of a body of water for offshore drilling and the term "subterranean" means at a location beneath the Earth's surface. Some of the downhole tools or components include, but are not limited to, packers, valves, sliding sleeves, fluid samplers, and downhole sensors. Digital information can be encoded in a series of acoustic waves. This information can be used to determine if a packer has set, to activate a valve, to move a sliding sleeve, to communicate with a downhole sensor reading, etc.

Another example of using acoustics to send information about a wellbore component is relaying information from a downhole sensor. The downhole sensor can measure characteristics of wellbore fluids and/or characteristics of the bottomhole of the subterranean formation and/or characteristics of the downhole tool. The characteristics of wellbore fluids can include without limitation, composition, relative composition, temperature, viscosity, density, and flow rate. The characteristics of the subterranean formation can include without limitation, temperature, pressure, and permeability. The characteristics of the downhole tool can include without limitation, temperature, voltage, operational health, and battery life.

In acoustics, sound waves are generated or propagate from a transmitter to a receiver. A device that functions as both a transmitter and a receiver is called a transceiver. The sound waves have a particular frequency, amplitude, and phase. The frequency is the number of waves that occur in a specific unit of time and can be reported in units of hertz (Hz). A frequency of 10 Hz means that 10 waves occur in 1 second (s). The amplitude is the difference between the crest and trough of the wave, or stated another way it is the height of the sound wave. The phase is the relative location of two sound waves that cross the same location at the same time. Data can be digitally encoded within sound waves. The data is encoded by an encoder. The encoder converts information from a processor, for example a sensor measurement (e.g., temperature) into a digital, electrical signal (e.g., data, a series of 1s and 0s that correspond to that temperature). The digital, electrical signal is then sent to a digital to analog "D/A" converter, which then converts the digital, electrical signal into an analog, electrical signal. The analog, electrical signal is sent to a transmitter, which converts the analog, electrical signal into a time-varying acoustic wave and transmits the data-encoded acoustic wave. The digital data is encoded in the time-varying acoustic wave by a change in: the frequency of the sound waves; the amplitude of the sound waves; the phase of the sound waves; or a combination of any of the three. This is known as modulation and can be frequency modulation, amplitude modulation, or phase modulation, respectively. For example, for frequency shift keying, a "0" could correspond to a specific frequency and a "1" could correspond to a different frequency. A receiver then receives the data-encoded acoustic waves and converts the acoustic waves into an analog, electrical signal. An analog to digital "A/D" converter then converts the analog, electrical signal into a digital, electrical signal, which is then sent to a decoder that converts the digital, electrical signal back in to information (e.g., the temperature). Another processor, for example a computer, can then be used to store and/or display the information and/perform a command. Information can also be relayed to downhole tools or components to communicate with or activate the tool or component.

Some or all of data-encoded sound waves may have difficulty reaching the receiver. Losses can occur when the sound waves encounter an impedance mismatch. Every object has its own unique impedance for a particular frequency. An impedance mismatch occurs when two objects do not have the same impedance at a particular frequency. For example, the acoustic impedance of a tubing string is related to the cross-sectional area of the solid structure, to the density of the solid structure, and to the modulus of the solid structure. Therefore, as sound waves travel up or down the tubing string, the connections cause a change in the acoustic impedance at the location of the connections due to an increase in the cross-sectional area at the connections. Changes in the acoustic impedance cause a partial or total reflection of the acoustic wave. Thus, some of the energy of the sound waves is lost due to the reflection. This loss in acoustic energy manifests as acoustic attenuation. If the waves are reflected back towards the origin, then depending on the phase of each wave traveling in the opposite directions at the same time, the sound wave either can be passed with minimal attenuation or can become severely attenuated. Other well system objects, such as large mass objects (e.g., packers, a wellhead, a subsea wellhead, a Christmas tree, a blow-out preventer, and liner hangers), tend to reflect more sound waves compared to smaller mass objects (e.g., the connections of a tubing string). Therefore, most of the acoustic signal never reaches the receiver past these large mass objects.

Previous attempts to overcome the problems associated with attenuation of sound waves from well system objects include increasing the acoustic signal strength that is being transmitted. However, increasing the strength of the signal may not be sufficient to ensure complete communication of information from the data-encoded sound waves. Increasing the signal strength can also cause other problems, such as it consumes more electrical power, produces more heat in the electronics, typically requires a larger and more expensive tool, and can create distortion. Thus, there exists a need to amplify a data-encoded acoustic signal such that the information encoded in the sound waves can be communicated to a receiver. The amplification needs to be sufficient to allow the sound waves to pass through all well system objects, including large mass objects, without having to increase the original signal strength.

It has been discovered that an amplification system can be used to amplify a data-encoded acoustic signal to communicate information about a well system or to a well system component. The amplification system includes an impedance mismatch point that is used in conjunction with a transmitter to amplify the acoustic signal. The acoustic signal is amplified to a sufficient amplitude such that the signal is transmitted through the well system objects. This system can be useful to transmit information through a variety of well system objects, including objects that have a large mass compared to other well system objects.

According to an embodiment, a method of amplifying a data-encoded acoustic signal in an oil or gas well system comprises: performing at least a first transmission of the data-encoded acoustic signal from a transmitter towards a receiver, wherein at least some of the data-encoded acoustic signal is reflected from a well system object; providing an impedance mismatch point; and causing or allowing amplification of the data-encoded acoustic signal, wherein the amplification is due to the well system object, the impedance mismatch point, and the transmitter.

According to another embodiment, a system for amplifying a data-encoded acoustic signal in an oil or gas well system comprises: a transmitter; a receiver, wherein the transmitter transmits a data-encoded acoustic signal towards the receiver; an oil or gas well system object, wherein at least some of the data-encoded acoustic signal is reflected from a well system object; an impedance mismatch point, wherein the data-encoded acoustic signal is amplified due to the well system object, the impedance mismatch point, and the transmitter.

Any discussion of the embodiments regarding the well system or any component related to the well system (e.g., the well system object) is intended to apply to all of the method and system embodiments. Any discussion of a particular component of an embodiment (e.g., a repeater) is meant to include the singular form of the component and the plural form of the component, without the need for continually referring to the component in both the singular and plural form throughout. As used herein the word "point" means at a particular location or range of locations within the well system and is not meant to imply the pointed end of an object nor to imply a location with zero length or width.

Figure 4:
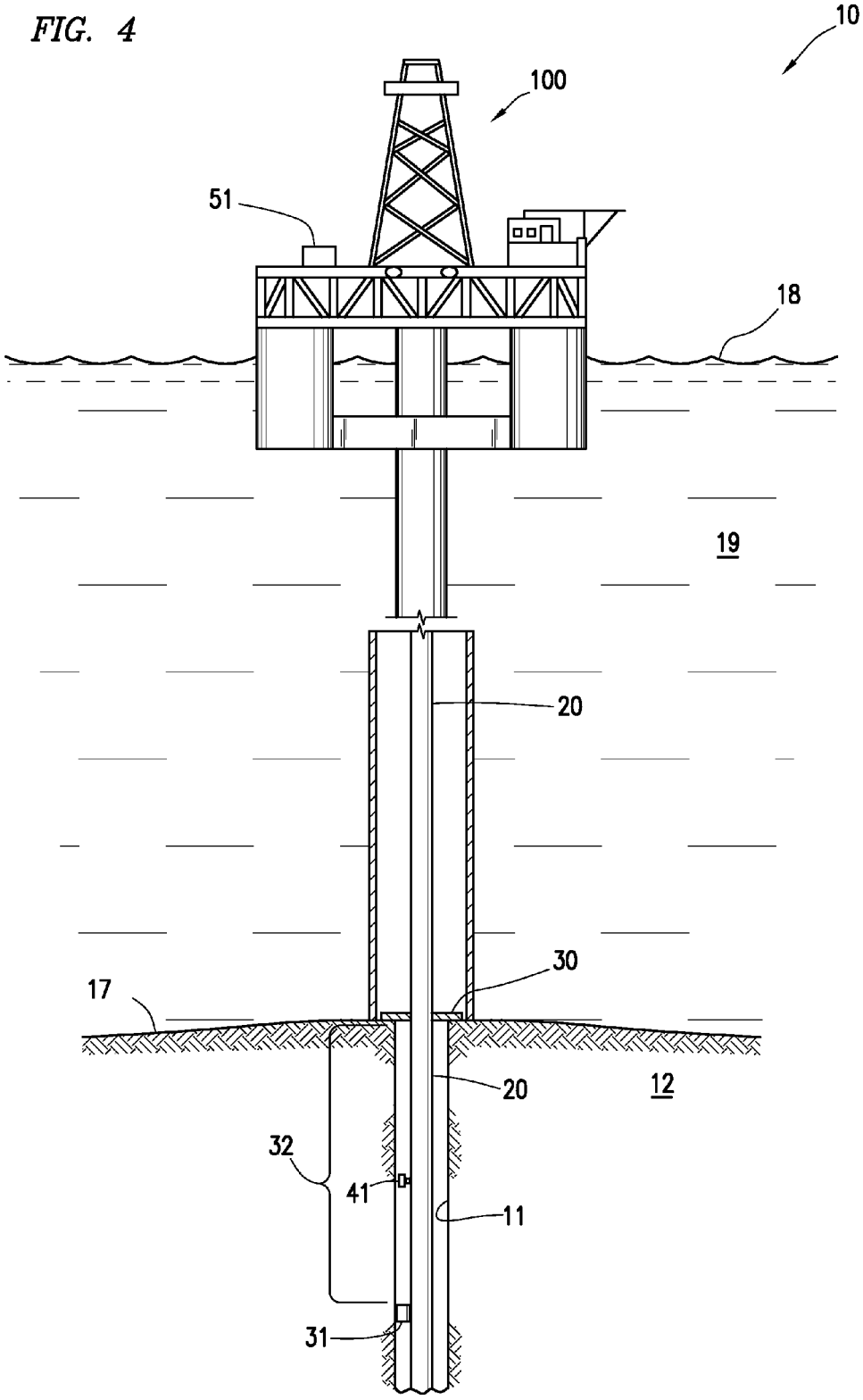
FIG. 4 is a schematic diagram showing an offshore well system according to an embodiment where the well system object is a blow-out preventer.

Turning to the Figures, FIG. 1 is a schematic diagram of a well system 10. The well system 10 includes a wellbore 11. The wellbore 11 is part of an oil, gas, or water well. The well can be a production well or an injection well. The wellbore 11 penetrates a subterranean formation 12, wherein the subterranean formation can be an oil, gas, and/or water reservoir or adjacent to the reservoir. The oil or gas well system can be on land or offshore. As depicted in FIG. 4, the well system 10 can be offshore and can include an offshore platform 100. The platform is located at the surface of the body of water 18 and a tubing string 20 runs from the platform through the body of water 19 to the surface of the formation 17 and into the formation wellbore 11. The wellbore 11 can include a cased portion and/or an open-hole portion. As shown in the Figures, the wellbore 11 can include a casing 13. The casing 13 can be cemented in place with cement 14. The well system 10 includes at least one tubing string 20. The wellbore 11 can contain one or more annuli 16. The annulus 16 can be located between any of the following: the outside of the tubing string 20 and the wall of the wellbore 11; the outside of the tubing string 20 and the inside of the casing 13; or the outside of the casing 13 and the wall of the wellbore 11; or the outside of a first tubing string and the inside of a second tubing string. Of course, there can be more than one annulus in various locations in the wellbore 11.

The well system 10 also includes a column of wellbore fluid 15. The column of wellbore fluid 15 can be located in the annulus 16 or in the inside of the tubing string 20. The wellbore fluid 15 can be any type of fluid that is used in oil, gas, or water well operations. For example, the wellbore fluid 15 can be a drilling fluid, completion fluid, work-over fluid, or enhanced recovery fluid. More specifically, the wellbore fluid 15 can be without limitation, a drilling mud, spacer fluid, brine, fracturing fluid, acidizing fluid, gravel pack fluid, or production fluids. There can also be more than one type of wellbore fluid 15 located in the wellbore 11 at a specific time. By way of example, a drilling mud can be located in the wellbore and then a spacer fluid can then be introduced into the wellbore such that both types of fluids are located within the wellbore. The line at which the type of fluid changes or a property of the fluid changes can be the impedance mismatch point 31. Any property of the fluid, for example, the density of the fluid that would cause an impedance mismatch could be used to create the impedance mismatch point 31.

The methods include performing at least a first transmission of the data-encoded acoustic signal from a transmitter 41 towards a receiver 51. The acoustic signal can be sent through a transmission medium. The transmission medium can be solid objects, such as a tubing 20 or casing 13 string, or a column of wellbore fluid 15. The transmitter 41 can be coupled to a component of the well system to provide acoustic coupling to the transmission medium. For example, the transmitter 41 can be directly attached to the inside or outside of the tubing string 20 or casing 13. The transmitter 41 can also be operatively connected to the outside or inside of the tubing string, or inside of the casing via a support 60. The use of the support 60 can be useful when the transmission medium is a column of wellbore fluid 15. The receiver 51 can be located at the wellhead or on a rig. Of course, for top-to-bottom information communication, the transmitter 41 could be located at the wellhead and coupled to the transmission medium, and the receiver 51 could be coupled to the transmission medium via a support 60 or direct connection.

The acoustic signal comprises sound waves that are digitally encoded with data. There are a variety of mechanisms by which the sound waves can be digitally encoded with the data. The digital data can be encoded in the time-varying acoustic wave by a change in: the frequency of the sound waves; the amplitude of the sound waves; the phase of the sound waves; or a combination of any of the three. Accordingly, the sound waves can be digitally encoded with the data via frequency modulation, amplitude modulation, phase modulation, or a combination of any of the three. The above-mentioned encoding techniques can also include on-off modulation, as well as quadrature modulation, differential modulation, and continuous modulation.

The data-encoded sound waves communicate information about the well system 10 or a component of the well system, and can be called bottom-to-top communication. The information can include without limitation, information from a downhole tool or component, information from a downhole sensor, or a command to a downhole tool or component or downhole sensor. Some of the downhole tools or components include, but are not limited to, packers, valves, sliding sleeves, and fluid samplers. By way of example, the information can be used to determine if a packer has set. The information can also be from a downhole sensor. The downhole sensor can measure inter alia characteristics of wellbore fluids and/or characteristics of the bottomhole of the subterranean formation and/or characteristics of the downhole tool. The characteristics of wellbore fluids can include without limitation, fluid composition, relative composition, temperature, viscosity, density, and flow rate. The characteristics of the subterranean formation can include without limitation, temperature, pressure, and permeability. The characteristics of the downhole tool can include without limitation, temperature, voltage, operational health, and battery life. The information can be analyzed and/or stored by a processor 80, such as a computer.

The transmitter 41 can also be used to send information or a command that communicates with or activates the downhole tool or component or a downhole sensor, and can be called top-to-bottom communication. The activation of the downhole tool or component can include without limitation, activation of a valve, to move a sliding sleeve, to communicate a downhole sensor reading, etc.

Figure 2:
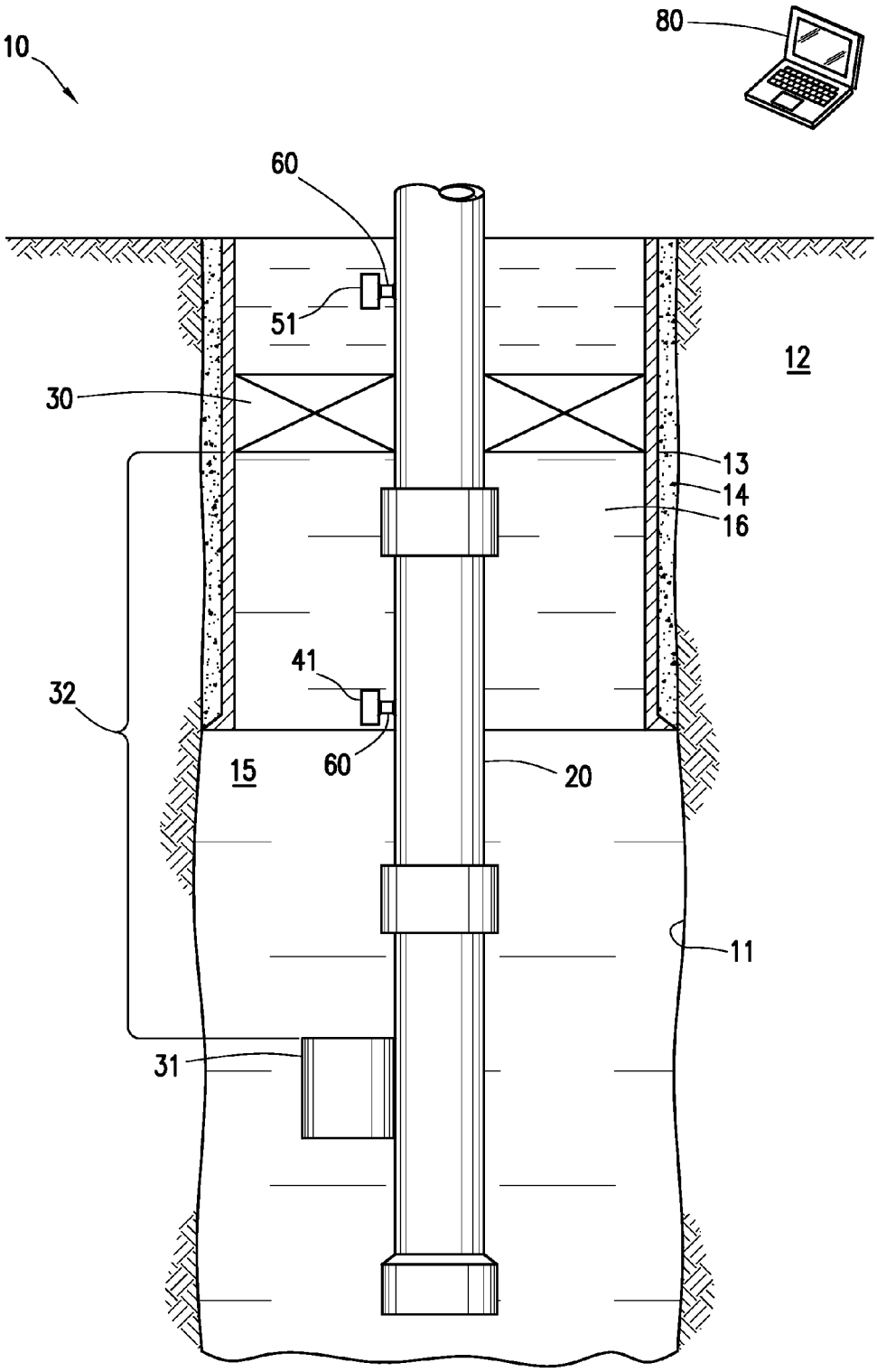
FIG. 2 is a schematic diagram showing the well system according to another embodiment where the transmitter is located between the impedance mismatch point and a well system object.
Figure 3:
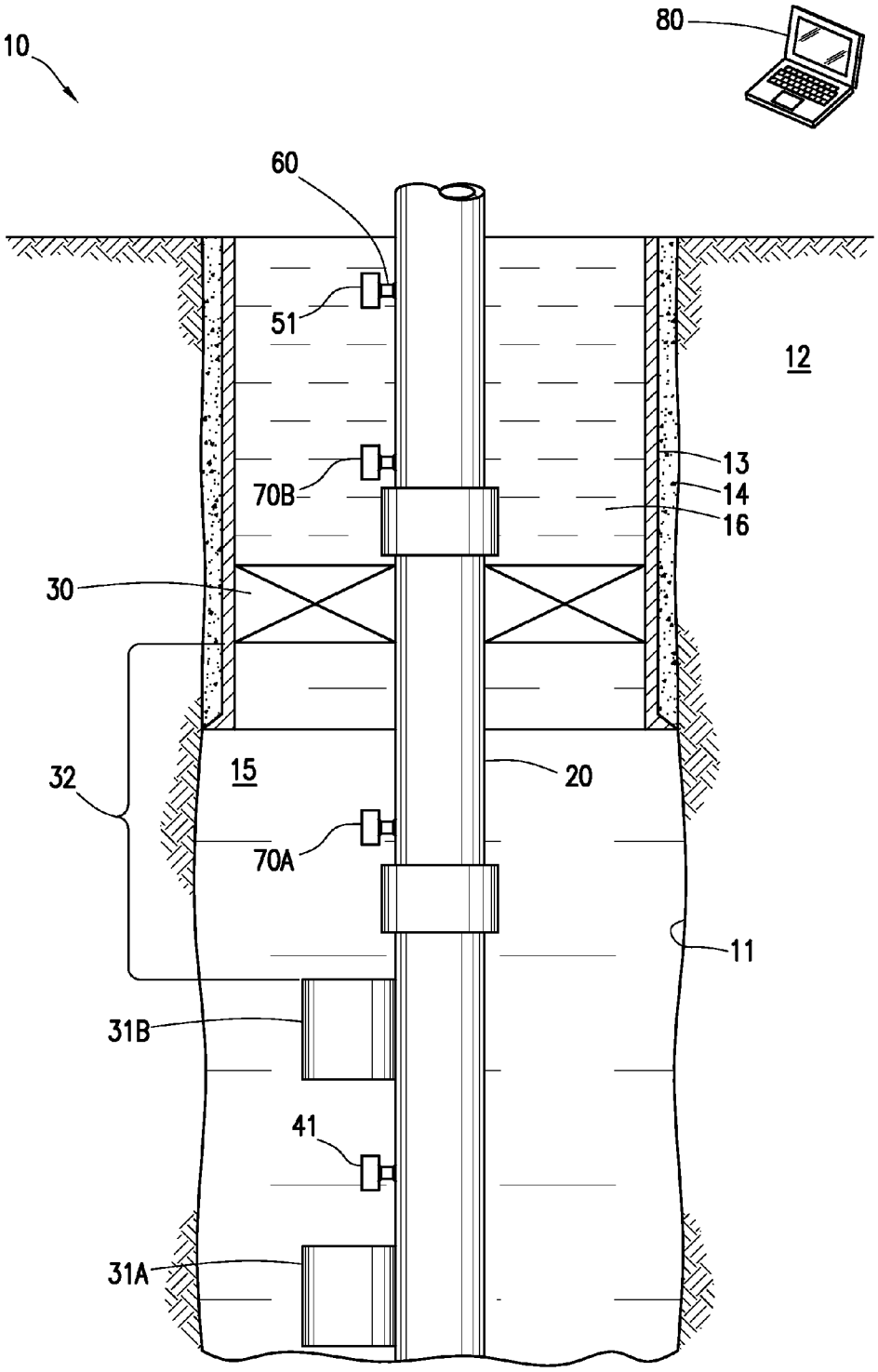
FIG. 3 is a schematic diagram showing a well system including more than one repeater.

The well system 10 includes at least one well system object 30. According to an embodiment, the well system object 30 has a larger mass than other well system objects. According to another embodiment, the well system object 30 has a cross-sectional area increase of at least a factor of 4, more preferably a factor of 10, from the cross-sectional area of the transmission medium (e.g., the cross-sectional area of the tubing string or the annulus containing the wellbore fluid). At least some of the data-encoded acoustic signal is reflected from the well system object 30. The amount of reflection is due to the difference in impedance between the well system object 30 and the transmission medium. For example, the larger the value is for the difference in impedance between the well system object 30 and the transmission medium, then the more reflection will occur as the sound waves reach the well system object 30. The larger the mass difference, or the larger the cross-sectional area difference, then there will be a larger difference in impedance. The well system object 30 can be without limitation, a packer (as depicted in FIGS. 1-3), a wellhead, a subsea wellhead, a Christmas tree, a blowout preventer (as depicted in FIG. 4), fluted hangers, and liner hangers. Of course, there can be more than one well system object 30 in the well system 10.

The transmitter 41 transmits data, for example with reference to a bottom-to-top transmission scheme, from the transmitter 41 up towards the wellhead. Some or all of the sound waves will be reflected at the well system object 30 when the waves encounter the object. Some of the waves will be reflected back down towards the transmitter 41.

The well system 10 includes an impedance mismatch point 31. The impedance mismatch point 31 is the location at which a difference occurs in the impedance between the transmission medium and a component of the well system other than the well system object 30. As can be seen in FIG. 1, the component of the well system that creates the impedance mismatch point 31 can be the transmitter 41. According to this embodiment, the mass, size, shape, and/or transmitter housing material can be selected to provide the desired impedance mismatch between the transmitter 41 and the transmission medium. The component of the well system that creates the impedance mismatch point 31 can also be, as discussed above, the line at which a change in wellbore fluid type or property of the wellbore fluid exists. As can be seen in FIG. 2, the transmitter 41 is located between the well system object 30 and the impedance mismatch point 31. According to this embodiment, the component of the well system that creates the impedance mismatch point 31 can be a large added mass or a series of smaller added masses.

As can be seen in FIG. 3, the well system 10 can further include one or more repeaters 70. The repeater 70 can be located between the transmitter 41 and the receiver 51. The repeater 70 can be acoustically coupled to the transmission medium. The repeater 70 can be used to repeat the data-encoded sound waves to either the next repeater or the receiver 51.

The impedance mismatch point 31 can be located below or above the well system object 30, depending on whether the transmitter is located below or above the well system object. As used herein, the relative term "below" means at a location farther away from the wellhead compared to a reference object. As used herein, the relative term "above" means at a location farther away from the wellhead compared to a reference object. According to an embodiment, at least a portion, and preferably the majority, of the acoustic signal that is reflected from the well system object 30 is reflected back towards the impedance mismatch point 31. When the reflected acoustic signal reaches the impedance mismatch point 31, then at least some of the data-encoded acoustic signal is reflected from the impedance mismatch point 31. At least some of the signal that is reflected from the impedance mismatch point 31 travels in a direction towards the well system object 30 and optionally the transmitter 41 when the transmitter is located between the well system object 30 and the impedance mismatch point 31. The area between the well system object 30 and the impedance mismatch point 31 is the resonant area 32.

The methods include causing or allowing amplification of the data-encoded acoustic signal via the impedance mismatch point 31 and the transmitter 41. The transmitter 41 can perform the first transmission of the data-encoded acoustic signal, wherein at least some of the signal is reflected from the well system object 30 towards the impedance mismatch point 31. According to an embodiment, the transmitter 41 has concluded the first transmission before the signal is reflected from the well system object 30. According to this embodiment, the vertical distance of the resonant area 32 is selected such that the transmitter 41 has concluded the first transmission before the signal is reflected from the well system object 30. In this manner, none of the sound waves are canceled due to destructive interference. At least some of the reflected sound waves from the first transmission are then reflected from the impedance mismatch point 31 back towards the well system object 30. It is to be understood that some of the sound waves can pass through the well system object 30 and or the impedance mismatch point 31, but the majority of the data-encoded waves should be reflected back and forth within the resonant area 32 to amplify the signal. The transmitter 41 can then perform a second transmission of the data-encoded acoustic signal, wherein the second transmission waves are in phase with the reflected waves from the impedance mismatch point 31 from the first transmission. In this manner, the waves from the second transmission build or amplify the waves from the first transmission and the waves experience constructive interference. The transmitter thus, builds the signal to a larger amplitude at each transmission. Accordingly, it is important that the transmitter perform each subsequent transmission to enable the waves to stay in resonance with all of the reflected waves. According to an embodiment, the transmitter 41 continues to transmit a desired number of times until the data-encoded acoustic signal is amplified enough to transmit through the well system object 30 and to the receiver 51. For example, the amplification process can be repeated a sufficient number of times (e.g., the transmitter 41 can perform a third, fourth, fifth, and so on transmission in phase with all the reflected waves) until the signal strength is high enough such that the data-encoded acoustic signal passes through the well system object 30 and all of the information is received by the receiver 51.

According to an embodiment, the transmitter 41 maintains the signal in phase with the reflected signal based on the resonant frequencies of the system. The step of causing can include using a sensor to monitor the phase of voltage or current being applied to the transmitter 41. The transmitter 41 can then be programmed or an operator can manually activate the transmitter to perform each subsequent transmission such that the waves are in phase and constructive interference occurs and the signal is amplified at each transmission.

According to another embodiment, the distance of the resonant area 32 can be predetermined and selected such that the transmitted waves remain in phase with all of the reflected waves. Moreover, the properties of the well system component (e.g., the mass, volume, or material) that causes the impedance mismatch point 31 can be predetermined and selected such that the transmitted waves remain in phase with all of the reflected waves.

According to an embodiment, the well system component that creates the impedance mismatch point 31 has a resonance, wherein the resonance matches the transmission frequency. By way of example, the component can include a spring or series of springs for a series of spaced added masses wherein the springs create the resonance for the component. The resonance can be selected and the springs can be modified such that the resonance of the component matches the transmission frequency.

The well system component that creates the impedance mismatch point 31 can have the same mass as the well system object 30; however, the signal to noise ratio should be different at an area above the well system object and at an area below the well system object. An example of this embodiment is when the well system object 30 is a subsea wellhead located at the surface of the subterranean formation 17 (as depicted in FIG. 4). The signal to noise ratio above the subsea wellhead in the body of water 19 is much lower compared to the signal to noise ratio below the subsea wellhead in the subterranean formation 12.

The amplification system can also be designed to allow select passing of desired frequencies. The following example is best described with reference to FIG. 3. The transmitter 41 can transmit the data-encoded acoustic signal at a first frequency to a first repeater 70A, and the impedance mismatch point 31B can have a low impedance at that first frequency such that the sound waves reach the first repeater. The first repeater 70A can then transmit the data-encoded acoustic signal to the second repeater 70B at a second frequency. The impedance mismatch point 31B can have a high impedance to the second frequency such that the sound waves are amplified within the resonant area 32 and eventually pass through the well system object 30, which is depicted as a packer, to the receiver 51. The system can be fine-tuned to allow selective passing and amplification at a desired frequency or range of frequencies.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. It is to be understood that multiple claims and/or embodiments disclosed herein can be combined in a variety of ways. Such combinations can define further embodiments. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b,") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of amplifying a data-encoded acoustic signal in an oil or gas well system comprising:

performing at least a first transmission of the data-encoded acoustic signal from a transmitter towards a receiver, wherein at least some of the data-encoded acoustic signal is reflected from a well system object;

providing an impedance mismatch point; and causing or allowing amplification of the data-encoded acoustic signal, wherein the amplification is due to the well system object, the impedance mismatch point, and the transmitter.

2. The method according to claim 1, wherein the data-encoded sound waves communicate information about the well system or to a component of the well system.

3. The method according to claim 2, wherein the information is: from a downhole tool or component; from a downhole sensor; or a command to a downhole tool, component, or sensor.

4. The method according to claim 1, wherein the data-encoded acoustic signal is transmitted through a transmission medium, and wherein the transmission medium is a solid object or a column of a wellbore fluid located within a wellbore of the well system.

5. The method according to claim 4, wherein the well system object has a cross-sectional area increase of at least a factor of 4 from the cross-sectional area of the transmission medium.

6. The method according to claim 1, wherein the well system object is a packer, a wellhead, a subsea wellhead, a Christmas tree, a blowout preventer, fluted hangers, or liner hangers.

7. The method according to claim 1, wherein a component of the well system creates the impedance mismatch point, wherein the component is different from the well system object.

8. The method according to claim 7, wherein the component of the well system is the transmitter, a line at which a change in a wellbore fluid type or property of a wellbore fluid exists; a large added mass; or a series of smaller added masses.

9. The method according to claim 1, wherein the well system further comprises one or more repeaters, wherein the repeater is located between the transmitter and the receiver.

10. The method according to claim 1, wherein the transmitter has concluded the first transmission before the signal is reflected from the well system object.

11. The method according to claim 1, further comprising a resonant area located between the well system object and the impedance mismatch point, and wherein the axial distance of the resonant area is selected such that the transmitter has concluded the first transmission before the signal is reflected from the well system object.

12. The method according to claim 1, and wherein the axial distance of the resonant area is selected such that the resonant frequency of the resonant area reinforces the carrier frequency of the transmitter.

13. The method according to claim 1, wherein the at least some of the signal that is reflected from the well system object is reflected towards the impedance mismatch point.

14. The method according to claim 13, wherein at least some of the reflected signal from the first transmission are then reflected from the impedance mismatch point back towards the well system object.

15. The method according to claim 14, further comprising performing a second transmission of the data-encoded acoustic signal from the transmitter towards the receiver, wherein the second transmission acoustic signal is in phase with the reflected signal from the impedance mismatch point from the first transmission.

16. The method according to claim 15, wherein the transmitted signal from the second transmission amplifies the signal from the first transmission and the signals experience constructive interference.

17. The method according to claim 16, further comprising performing more than two transmissions of the data-encoded acoustic signal, wherein each transmission signal is in phase with all of the reflected signals.

18. The method according to claim 17, wherein the transmitter maintains the transmitted signals in phase with the reflected signals based on the resonant frequencies of the well system.

19. The method according to claim 17, wherein a sufficient number of transmissions occur until the signal strength is high enough such that the data-encoded acoustic signal passes through the well system object and reaches the receiver.

20. A system for amplifying a data-encoded acoustic signal in an oil or gas well system comprising:

a transmitter;

a receiver, wherein the transmitter transmits the data-encoded acoustic signal towards the receiver;

an oil or gas well system object, wherein at least some of the data-encoded acoustic signal is reflected from the well system object;

an impedance mismatch point, wherein the data-encoded acoustic signal is amplified due to the well system object, the impedance mismatch point, and the transmitter.

* * * * *